US005687448A

United States Patent [19]

Dye, Jr.

[11] Patent Number: 5,687,448

[45] Date of Patent: Nov. 18, 1997

[54] ADJUSTABLE CEMENT FINISHING TOOL

[76] Inventor: Walter C. Dye, Jr., 31964 Camino Marea, Temecula, Calif. 92592

[21] Appl. No.: 610,322

[22] Filed: Mar. 4, 1996

[51] Int. Cl.[6] ..... E01C 19/44; E01C 19/22

[52] U.S. Cl. ..... 15/235.8; 15/144.1; 403/87; 403/4; 403/110; 404/97; 404/118

[58] Field of Search ..... 15/235.8, 235.4, 15/245.1, 144.1, 145, 235.6, 143.1, 172; 16/114 R; 403/87, 110, 4, 84; 425/458; 404/118, 97, 98

[56] References Cited

U.S. PATENT DOCUMENTS

| | | | |
|---|---|---|---|
| 1,080,075 | 12/1913 | Runner | 15/235.8 |
| 1,095,873 | 5/1914 | Jayne | 403/87 |
| 1,171,738 | 2/1916 | Mallet | 15/144.1 |
| 1,585,571 | 5/1926 | Swanson | 404/97 |
| 2,641,513 | 6/1953 | Fryda | 15/144.1 |
| 3,090,066 | 5/1963 | Ferrell, Jr. et al. | 15/235.8 |
| 3,206,708 | 9/1965 | Hahn | 15/235.8 |
| 4,520,527 | 6/1985 | Maggio et al. | 15/235.8 |
| 5,115,536 | 5/1992 | Jarvis | 15/235.8 |
| 5,393,168 | 2/1995 | Jarvis | 15/235.8 |
| 5,433,278 | 7/1995 | Shipley | 403/87 |

FOREIGN PATENT DOCUMENTS

| | | | |
|---|---|---|---|
| 611386 | 9/1926 | France | 15/144.1 |

*Primary Examiner*—Gary K. Graham

[57] ABSTRACT

An adjustable cement finishing tool including a generally planar float; a rigid mounting bracket coupled to an upper extent of the float; a swiveling member pivotally coupled to the mounting bracket; and a generally elongated arm with a central axis coupled to the swiveling member, and wherein rotating the arm in one direction about its central axis allows it to become engaged with the swiveling member to thereby preclude pivotal movement of the float, and wherein rotating the arm in an opposite direction about its central axis allows it to become disengaged from the swivelling member and thereby allow pivotal movement of the float.

2 Claims, 3 Drawing Sheets

2
2
10
92
94
22
20
12
14

90
50
56
68
18
30

ADJUSTABLE CEMENT FINISHING TOOL

BACKGROUND OF THE INVENTION

1. Field of the Invention

The present invention relates to an adjustable cement finishing tool and more particularly pertains to allowing a user to attain an even finish on a surface of wet cement with an adjustable cement finishing tool.

2. Description of the Prior Art

The use of cement finishing tools is known in the prior art. More specifically, cement finishing tools heretofore devised and utilized for the purpose of smoothing concrete surfaces are known to consist basically of familiar, expected and obvious structural configurations, notwithstanding the myriad of designs encompassed by the crowded prior art which have been developed for the fulfillment of countless objectives and requirements.

By way of example, U.S. Pat. Des. No. 246,569 to Wesson discloses a cement finishing tool. U.S. Pat. Des. No. 343,998 to Griggs discloses a concrete finishing tool bracket. U.S. Pat. No. 4,155,141 to Guerra discloses a cement finishing tool. U.S. Pat. No. 4,520,527 to Maggio et al. discloses a concrete finishing tool. U.S. Pat. No. 5,098,278 to Brandvold discloses a concrete finishing tool. U.S. Pat. No. 5,115,536 to Jarvis discloses an adjustable concrete finishing tool.

While these devices fulfill their respective, particular objective and requirements, the aforementioned patents do not describe an adjustable cement finishing tool that has a handle that when axially rotated in one direction prevents pivotal movement of an associated float and when axially rotated in another direction allows such pivotal movement.

In this respect, the adjustable cement finishing tool according to the present invention substantially departs from the conventional concepts and designs of the prior art, and in doing so provides an apparatus primarily developed for the purpose of allowing a user to attain an even finish on a surface of wet cement.

Therefore, it can be appreciated that there exists a continuing need for new and improved adjustable cement finishing tool which can be used for allowing a user to attain an even finish on a surface of wet cement. In this regard, the present invention substantially fulfills this need.

SUMMARY OF THE INVENTION

In the view of the foregoing disadvantages inherent in the known types of cement finishing tools now present in the prior art, the present invention provides an improved adjustable cement finishing tool. As such, the general purpose of the present invention, which will be described subsequently in greater detail, is to provide a new and improved adjustable cement finishing tool and method which has all the advantages of the prior art and none of the disadvantages.

To attain this, the present invention essentially comprises, in combination, a generally horizontal rectangular rigid planar float having a substantially planar lower surface, an upper surface with a centrally located longitudinal raised portion, and a centrally located pair of threaded bores formed on the raised portion. A rigid mounting bracket is included and has a horizontal rectangular rigid planar base with a pair of receiving holes formed thereon, an upwardly extending lower tongue member with a rounded upper edge, straight parallel side edges, and a centrally located through hole. A pair of threaded bolts is provided wherein each bolt is separately disposed through a receiving hole and threadedly secured within one of the bores of the float to thereby fixedly secure the mounting bracket to the float.

A swiveling member is included and has a generally tubular rigid shell with a horizontally positioned longitudinal central axis, a centrally located and substantially semicircular groove formed on an upper portion the shell and aligned in a plane perpendicular to the central axis, a centrally located upper tongue. The upper tongue is formed of a pair of spaced upper tongue members extending downwards and positioned on opposing sides of the lower tongue member. The upper tongue members are thus placed in facing contact with the lower tongue member. Each upper tongue member has a rounded upper edge, straight parallel side edges, and a centrally located through hole. A threaded bolt is provided and disposed within the through holes of the upper and lower tongues members and secured with a nut to thereby fixedly fasten the tongue members together.

A rigid cylindrical inner member is included. The inner member is slidably disposed within the shell. The inner member has a smooth exterior surface, a horizontally positioned longitudinal axis, a centrally located receiving bore extending through a central portion of the inner member at a location perpendicular to the longitudinal axis, and a generally crescent-shaped recess formed on a lower extent of the exterior surface in communication with the receiving bore. A generally rectangular plate is provided and has a curved interior surface that conforms to the shape of the exterior surface of the inner member and a centrally positioned receiving bore disposed therethrough. In addition, a fastening bolt having an elongated threaded upper portion is disposed through the receiving bore of the inner member and the receiving bore of the plate. The fastening bolt has a lower crescent shaped head seated within the recess of the inner member.

Lastly, a generally tubular arm is included and has a central axis, an open upper end adapted for receiving an elongated handle, a sealed lower end with an axially aligned and threaded bore formed thereon, and a threaded nut fixedly secured to the lower end of the bolt. The bolt of the swiveling member is threadedly secured to the nut and within the bore of the arm to thereby couple the float to the arm. Rotating the arm in one direction about its central axis allows the lower end of the arm to be engaged with the swivelling member to thereby preclude pivotal movement of the float. Rotating the arm in an opposite direction about its central axis allows the lower end of the arm to be disengaged from the swivelling member and thereby allow pivotal movement of the float within an angular limit as set by the groove on the shell.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable cement finishing tool which has all the advantages of the prior art cement finishing tools and none of the disadvantages.

It is another object of the present invention to provide a new and improved adjustable cement finishing tool which may be easily and efficiently manufactured and marketed.

It is a further object of the present invention to provide a new and improved adjustable cement finishing tool which is of durable and reliable construction.

An even further object of the present invention is to provide a new and improved adjustable cement finishing tool which is susceptible of a low cost of manufacture with regard to both materials and labor, and which accordingly is then susceptible of low prices of sale to the consuming public, thereby making such an adjustable cement finishing tool economically available to the buying public.

Still yet another object of the present invention is to provide a new and improved adjustable cement finishing tool which provides in the apparatuses and methods of the prior art some of the advantages thereof, while simultaneously overcoming some of the disadvantages normally associated therewith.

Even still another object of the present invention is to provide a new and improved adjustable cement finishing tool for allowing a user to attain an even finish on a surface of wet cement.

Lastly, it is an object of the present invention to provide a new and improved adjustable cement finishing tool comprising a generally planar float; a rigid mounting bracket coupled to an upper extent of the float; a swiveling member pivotally coupled to the mounting bracket; and a generally elongated arm with a central axis coupled to the swiveling member, and wherein rotating the arm in one direction about its central axis allows it to become engaged with the swiveling member to thereby preclude pivotal movement of the float, and wherein rotating the arm in an opposite direction about its central axis allows it to become disengaged from the swivelling member and thereby allow pivotal movement of the float.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
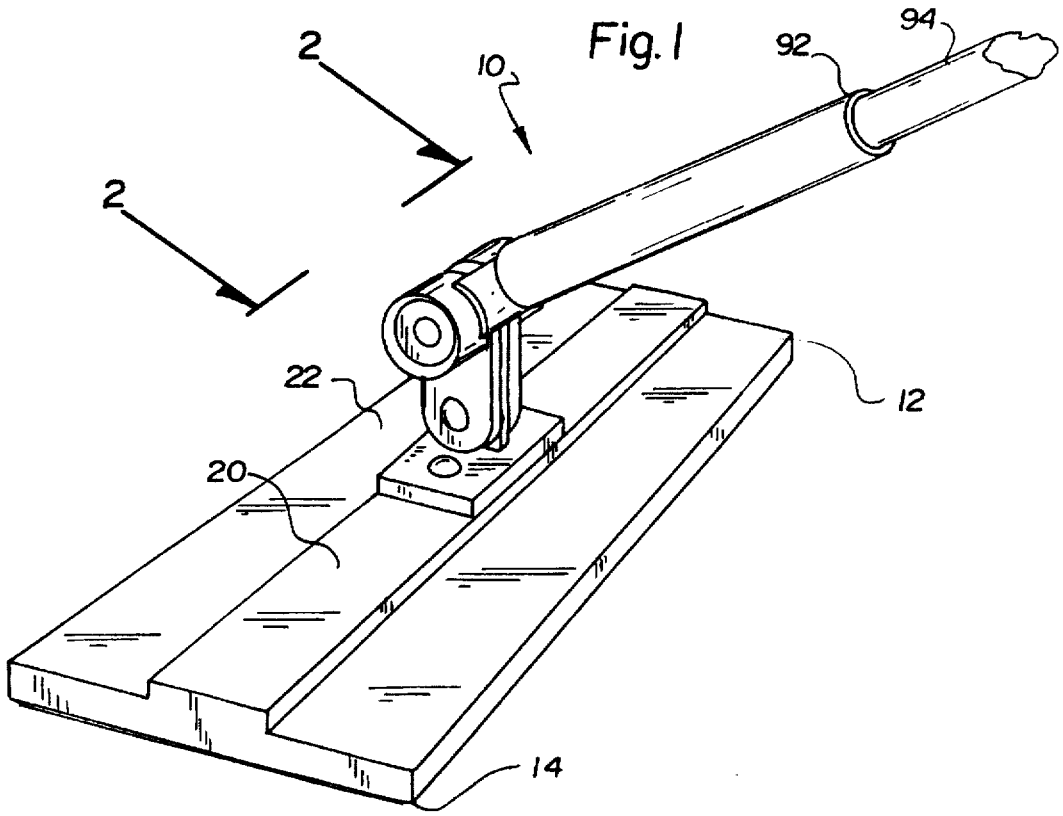
FIG. 1 is a perspective view of the preferred embodiment constructed in accordance with the principles of the present invention.
Figure 2:
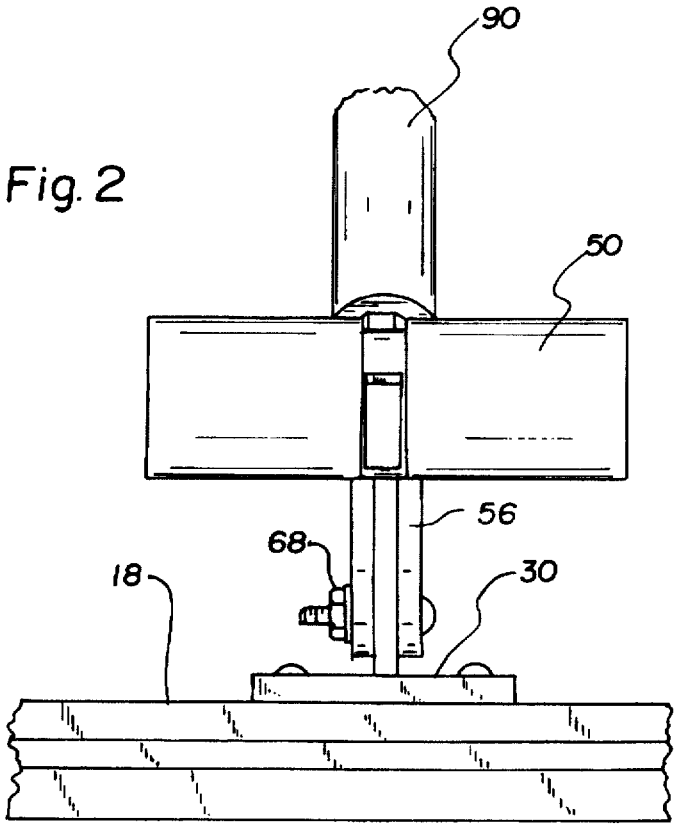
FIG. 2 is a view of the present invention taken along the line 2—2 of FIG. 1.
Figure 3:
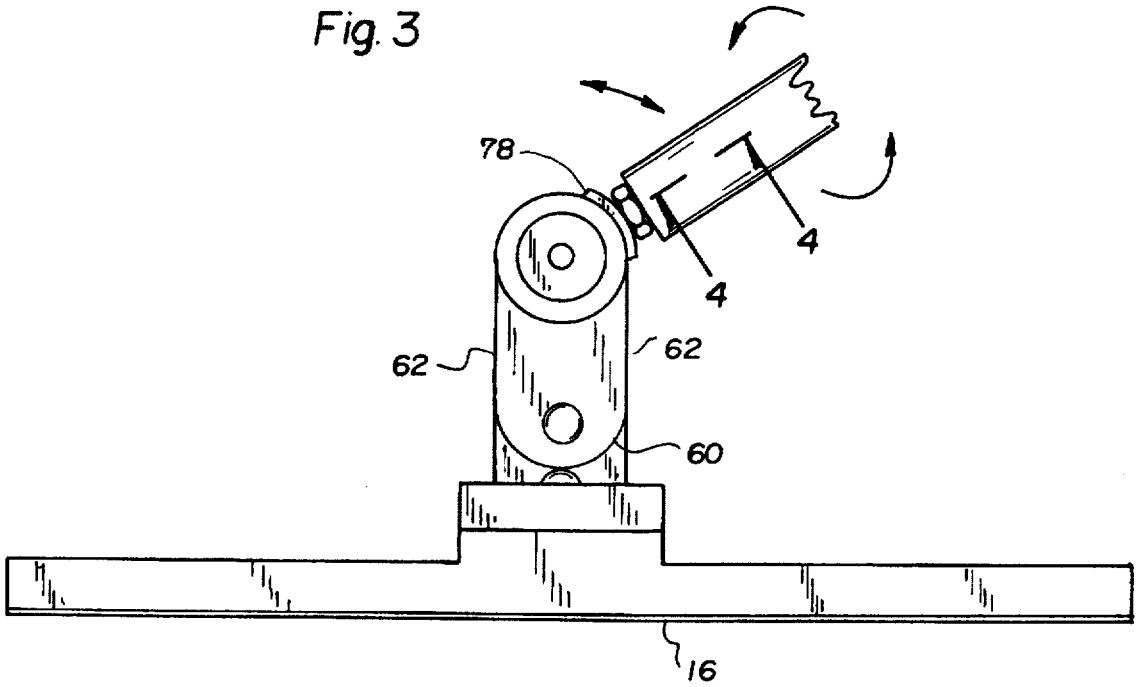
FIG. 3 is a side-elevational view of the preferred embodiment of the present invention.
Figure 4:
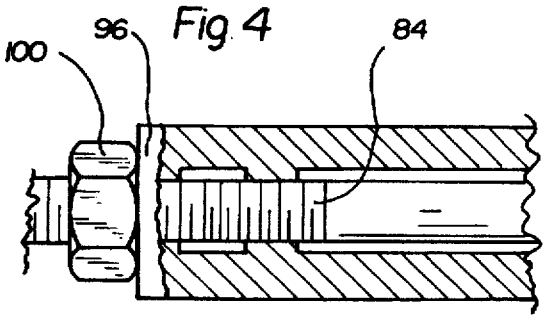
FIG. 4 is a cross-sectional view of the present invention taken along the line 4—4 of FIG. 3.
Figure 5:
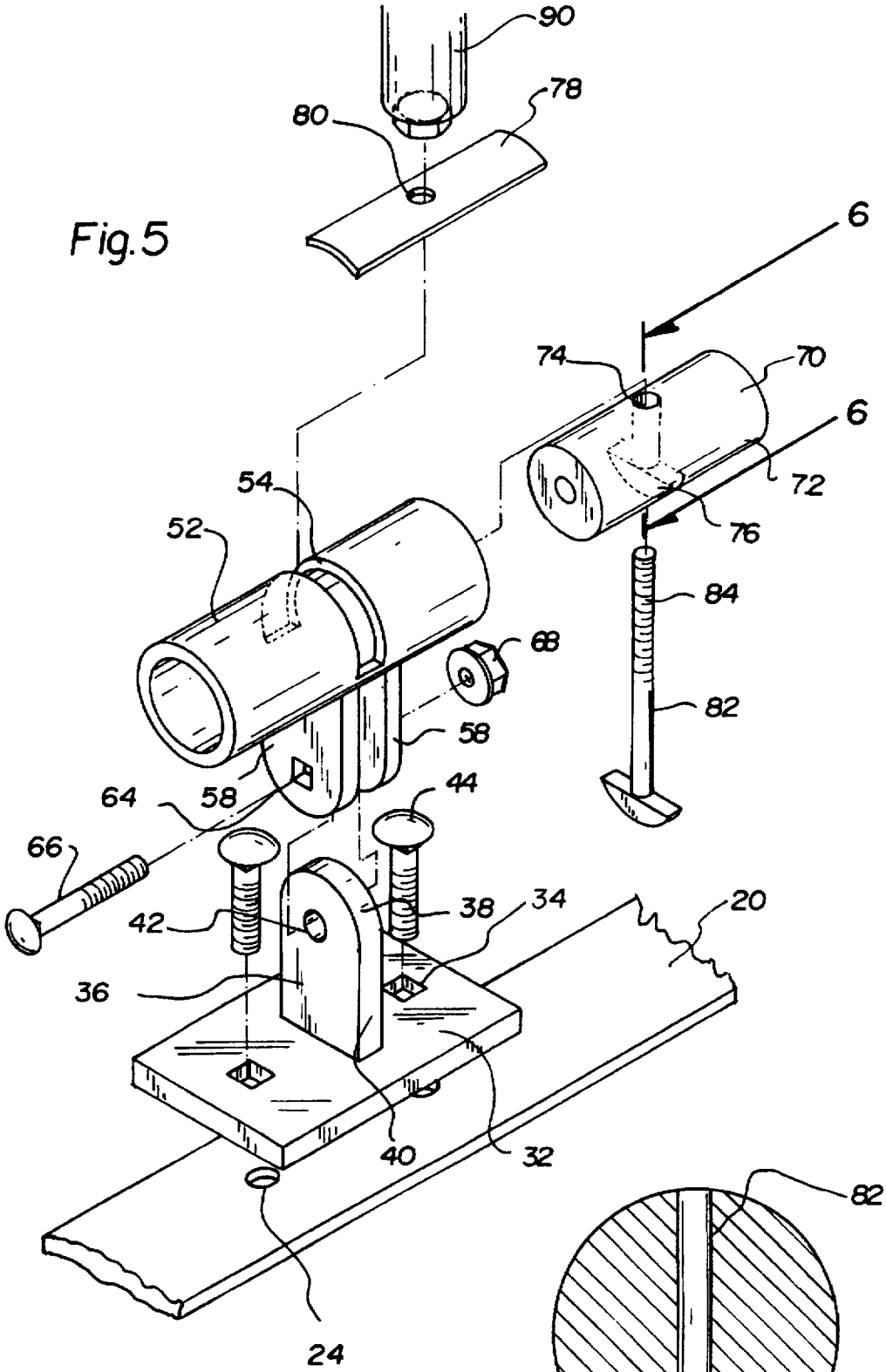
FIG. 5 is an exploded perspective view of the swiveling member and arm of the present invention.
Figure 6:
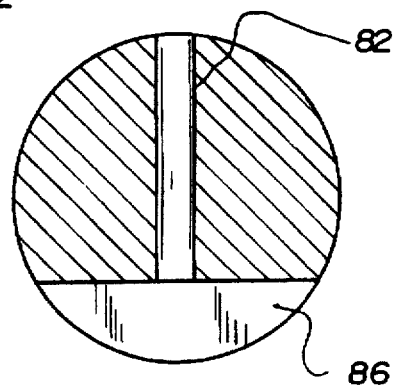
FIG. 6 is a cross-sectional view of the present invention taken along the line 6—6 of FIG. 5.

With reference now to the drawings, and in particular, to FIG. 1 thereof, the preferred embodiment of the new and improved adjustable cement finishing tool embodying the principles and concepts of the present invention and generally designated by the reference number 10 will be described.

The preferred embodiment of the present invention comprises a plurality of components. In their broadest context, such components include a float, mounting bracket, swiveling member, and arm. Such components are individually configured and correlated with respect to each other to provide the intended function of smoothing a surface of wet concrete or other material.

Specifically, the present invention includes a generally horizontal, rectangular, and rigid metal planar float 12. The float has a substantially planar lower surface 14 with an optional pad 16 or textured surface affixed thereto. The float also has an upper surface with a centrally located and longitudinal raised rectangular portion 20 with flat long side portions 22. In addition, the float includes a centrally located pair of spaced threaded bores 24 formed on the raised portion.

A rigid metal mounting bracket 30 is also provided. The mounting bracket has a horizontal rectangular rigid planar base 32 with a pair of receiving holes 34 formed thereon. Each receiving hole has a square cross-section. The mounting bracket has an upwardly extending and planar lower tongue member 36. The tongue member 36 has a rounded or U-shaped upper edge 38, straight parallel side edges 40, and a centrally located through hole 42. A pair of threaded bolts 44 are included. Each bolt has a lower extent, a dome-shaped upper extent, and an intermediate portion with a square cross-section therebetween. Each bolt is threadedly secured within one of the bores 24 of the float, thereby fixedly securing the mounting bracket 30 to the float 12.

A metal swiveling member 50 is included. The swiveling member has a generally tubular and rigid shell 52 with a horizontally positioned and longitudinal central axis. The shell also has a centrally located and substantially semicircular and rectangular shaped groove 54 formed on its upper portion. The groove is aligned in a plane that is perpendicular to the central axis. The swiveling member also has a centrally located upper tongue 56. The tongue is formed of a pair of spaced upper tongue members 58 that extend downwards at a location diametric to the groove. The tongue members are positioned on opposing sides of the lower tongue member 36 of the mounting bracket and are placed in facing contact therewith. Each upper tongue member has a rounded and U-shaped upper edge 60, straight parallel side edges 62, and a centrally located through hole 64 with a square cross-section. A threaded bolt 66 is disposed within the through holes 42, 64 of the upper and lower tongue members and then secured with a hexagonal nut 68. Bolt 66 is of the essentially same shape as bolt 44. The swiveling member has a rigid cylindrical or tubular inner member 70 that is slidably disposed within the shell 52. The inner member has a smooth exterior surface 72 and a centrally positioned longitudinal axis. A centrally located cylindrical smooth receiving bore 74 extends through a central portion of the inner member 70 at a location perpendicular to the longitudinal axis. In addition, a generally crescent-shaped recess 76 is formed on a lower extent of the exterior surface and placed in communication with the receiving bore. The swiveling member also includes a generally rectangular plate 78. The plate has a curved interior surface that conforms to the shape of the exterior surface of the inner member. The plate 78 has a centrally positioned receiving bore 80 disposed therethrough. A fastening bolt 82 having an elongated threaded upper portion 84 is disposed within the receiving bore of the inner member and the receiving bore of the plate. Bolt 82 has a lower crescent-shaped head 86 that is seated within the recess of the inner member to thereby preclude its movement.

Lastly, a generally tubular rigid metal arm 90 is provided. The arm has a central axis and an open upper end 92. End 92 is adapted for receiving an elongated handle 94. An optional unillustrated snap fastener is formed on the upper end for allowing attachment to the handle to thereby hold it in a fixed position. The arm also has a sealed lower end 96 with an axially aligned and threaded bore 98 formed thereon. A threaded hexagonal nut 100 is fixedly welded to the lower end of the bolt and axially aligned with the bore 98. The upper portion 84 of the bolt 82 of the swiveling member is threadedly secured to the nut 100 and within the bore 98 of the arm to thereby couple the float 12 to the arm 90 via the bracket 30 and swiveling member 50. Rotating the arm 90 in one direction about its central axis allows the lower end of the arm to be engaged with the swiveling member 50 to thereby preclude pivotal movement of the float. Rotating the arm in an opposite direction about its central axis allows the lower end of the arm 90 to be disengaged from the swiveling member and thereby allow pivotal movement of the float 12 via the swiveling member within a plane that is generally perpendicular to the float. Angular movement is limited by the length of the groove 54 on the shell. The groove can also be formed with greater or lesser lengths to allow a greater or lesser movement of the arm.

The present invention mounts on the end of a handle via an optional snap button formed on the upper end of the arm. The purpose of the present invention is to change the angle of the pole in relation to the tool without having to bring the tool away from the cement to adjust the position of the float. To adjust the angle of the float in relation to the arm, simply turn the arm counterclockwise to loosen or turn the arm clockwise to lock the float at a desired angle. Preferably, the arm has a length of about 10 inches. The present invention is fashioned from steel or aluminum. The present invention saves a person time and effort in finishing cement surfaces.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An adjustable cement finishing tool comprising, in combination:

a generally horizontal rectangular rigid planar float having a substantially planar lower surface, an upper surface with a centrally located longitudinal raised portion, and a centrally located pair of threaded bores formed on the raised portion;

a rigid mounting bracket having a horizontal rectangular rigid planar base with a pair of receiving holes formed thereon, an upwardly extending lower tongue member with a rounded upper edge, straight parallel side edges, and a centrally located through hole, and a pair of threaded bolts wherein each bolt is separately disposed through a receiving hole and threadedly secured within one of the bores of the float to thereby fixedly secure the mounting bracket to the float;

a swiveling member having a generally tubular rigid shell with a horizontally positioned longitudinal central axis, a centrally located and substantially semicircular groove formed on an upper portion the shell and aligned in a plane perpendicular to the central axis, a centrally located upper tongue formed of a pair of spaced upper tongue members extending downwards and positioned on opposing sides of the lower tongue member and in facing contact therewith and with each upper tongue member having a rounded upper edge, straight parallel side edges, and a centrally located through hole, a threaded bolt disposed within the through holes of the upper and lower tongues members and secured with a nut to thereby fixedly fasten the tongue members together, a rigid cylindrical inner member slidably disposed within the shell, the inner member having a smooth exterior surface, a horizontally positioned longitudinal axis, a centrally located receiving bore extending through a central portion of the inner member at a location perpendicular to the longitudinal axis, and a generally crescent-shaped recess formed on a lower extent of the exterior surface in communication with the receiving bore, a generally rectangular plate having a curved interior surface that conforms to the shape of the exterior surface of the inner member and a centrally positioned receiving bore disposed therethrough, and a fastening bolt having an elongated threaded upper portion disposed through the receiving bore of the inner member and the receiving bore of the plate and a lower crescent shaped head seated within the recess of the inner member; and a generally tubular arm having a central axis, an open upper end adapted for receiving an elongated handle, a sealed lower end with an axially aligned and threaded bore formed thereon, and a threaded nut fixedly secured to the lower end of the bolt, and wherein the bolt of the swiveling member is threadedly secured to the nut and within the bore of the arm to thereby couple the float to the arm, and wherein rotating the arm in one direction about its central axis allows the lower end of the arm to be engaged with the swivelling member to thereby preclude pivotal movement of the float, and wherein rotating the arm in an opposite direction about its central axis allows the lower end of the arm to be disengaged from the swivelling member and thereby allow pivotal movement of the float within an angular limit as set by the groove on the shell.

2. An adjustable cement finishing tool comprising:

a generally planar float;

a mounting bracket being fixedly secured to an upper extent of the planar float, the mounting bracket having an upwardly extending lower tongue member;

a swiveling member having a generally tubular shell, an arcuate groove formed on and extending through an upper portion of the shell, an upper tongue extending downwards and coupled to the lower tongue member of the mounting bracket, a generally cylindrical inner member slidably disposed within the shell and a threaded fastening bolt attached to said inner member and extending outwardly through said groove; and a generally elongated arm with a central axis coupled to the swiveling member, and wherein rotating the arm in one direction about its central axis allows it to become engaged with the swiveling member to thereby preclude pivotal movement of the planar float, and wherein rotating the arm in an opposite direction about its central axis allows it to become disengaged from the swivelling member and thereby allow pivotal movement of the planar float, the elongated arm has an open upper end adapted for receiving an elongated handle and a sealed lower end with a threaded fore formed thereon threadedly receiving the fastening bolt of swiveling member.

* * * * *